United States Patent [19]

MacDonald et al.

[11] 4,008,551

[45] Feb. 22, 1977

[54] RELIEF PANEL AND METHOD OF MAKING SAME

[76] Inventors: Edward J. MacDonald, 180 Border St., Scituate, Mass. 02066; Kenneth A. MacDonald, 251 York St., Canton, Mass. 02021

[22] Filed: Apr. 4, 1975

[21] Appl. No.: 565,143

[52] U.S. Cl. ..... 52/316; 52/312; 52/456; 52/622; 156/257; 156/268; 428/67

[51] Int. Cl.[2] ..... E04C 1/40

[58] Field of Search ..... 52/309, 312, 316, 622, 52/623, 455, 456; 312/204; 156/257, 268; 428/60, 63, 67, 125, 133, 163, 167

[56] References Cited

UNITED STATES PATENTS

| | | | |
|---|---|---|---|
| 1,927,882 | 9/1933 | Wilnus | 52/312 |
| 1,988,236 | 1/1935 | Chatfield | 52/312 |
| 2,253,667 | 8/1941 | Warner | 156/268 X |
| 2,842,420 | 7/1958 | Hansen et al. | 312/204 X |
| 3,022,207 | 2/1962 | Lang | 156/257 |
| 3,731,444 | 5/1973 | Tobin | 52/316 |

FOREIGN PATENTS OR APPLICATIONS

| | | | |
|---|---|---|---|
| 955,517 | 4/1964 | United Kingdom | 52/309 |

*Primary Examiner*—Alfred C. Perham
*Attorney, Agent, or Firm*—Morse, Altman, Oates & Bello

[57] ABSTRACT

Structural and decorative boards laminated with a hard plastic veneer are given a relief appearance by forming a rabbeted groove, preferably rectangular in outline, and mounting therein tapered laminated strips having a thickness along one edge substantially corresponding to the depth of the groove and along the opposite narrow edge being substantially flush with the base of the groove. The entire panel thus presents a relief configuration while the exposed surfaces are covered by the plastic veneer. The panels may be used for doors used in kitchen cabinets, bathroom vanities and the like.

9 Claims, 6 Drawing Figures

RELIEF PANEL AND METHOD OF MAKING SAME

BACKGROUND OF THE INVENTION

1. Field of the Invention

This invention relates generally to products manufactured from plastic veneer hardboard and more particularly is directed towards a new and improved method of providing a relief surface to a panel having wood core laminated with a hard plastic outer surface and the product made thereby.

2. Description of the Prior Art

Many products utilize hardboards such as those sold under the trademark "Formica" and which includes a stratum of urea-and phenol-formaldhyde resins, bonded to a sheet of plywood, chipboard or the like. Such panels are strong and the hard plastic veneer is extremely durable and presents a smooth, hard surface. Such laminated boards are used for wall panels in some instances but more commonly are used in kitchen cabinets, vanities and the like where resistance to water spotting, ease of cleaning and othe characteristics are desirable.

While cabinets fabricated, either in whole or in part, by such laminated boards are very durable and functional they are limited with respect to the design configurations which may be produced using such boards. Generally, such boards are available only in flat, smooth stock which cannot be milled into attractive cabinet-work since the milling would destroy the hard plastic veneer. As a result, cabinets currently available which are fabricated from such laminated board have utilized doors, panels, etc., which are either completely flat and smooth or have a very light, shallow scoring formed therein in an attempt to provide some relief appearance to the product. Such scoring is generally very shallow and is less than the thickness of the plastic veneer, typically one-sixteenth inch thick, so as to maintain the integrity of the laminate.

Accordingly, it is an object of the present invention to provide a novel method for producing a genuine relief surface to such laminated boards while maintaining an outer exposed surface of the panel that is substantially fully covered by the hard plastic veneer. A further object of the invention is to provide cabinet doors, panels and the like fabricated from plastic veneer boards with a true relief outer surface.

SUMMARY OF THE INVENTION

This invention features the method of producing a relief surface in an initially smooth, flat panel made from a wood core and a hard plastic veneer, comprising the steps of forming a rabbeted groove through the plastic veneer and into the core and then mounting a strip within the groove, said strip being transversely tapered and of a width corresponding to the width of the groove.

This invention also features a relief panel of a wood core and plastic veneer construction comprising a flat panel formed with an undercut groove through the plastic veneer and into the core of the panel and a transversely tapered insert mounted in the groove, the insert being faced with a hard plastic veneer to provide a substantially continuous surface of plastic veneer to the outer face of the panel.

DETAILED DESCRIPTION OF THE PREFERRED EMBODIMENTS

Figure 1:
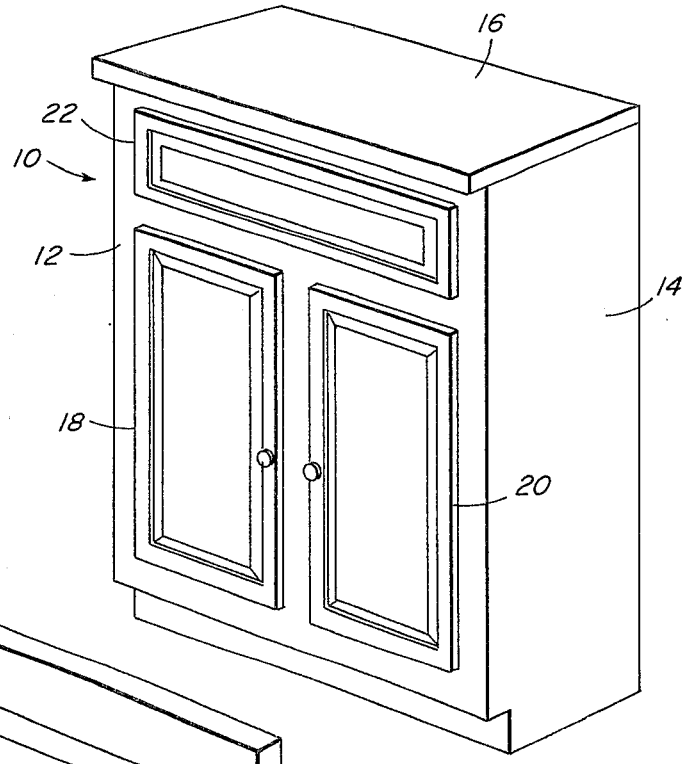
FIG. 1 is a view in perspective of a cabinet fabricated with doors and panels sections made according to the invention.

Referring now to the drawings and to FIG. 1 in particular, the reference character 10 generally indicates a cabinet of the sort used in kitchens, bathrooms and the like, and comprised of the usual front frame 12, sidewalls 14 and countertop 16. Typically, such cabinets include a pair of doors 18 and 20 and a panel 22 which may be either the outer end of a drawer or, if the cabinet 10 is used as a vanity with a sink (not shown) mounted in the counter, the panel 22 would be a fixed decorative trim piece.

Cabinets of the type illustrated in FIG. 1, in many instances, are fabricated largely of a laminated board material in which the core is a wood fibre material such as plywood or chip board while the outer surface is a hard plastic veneer such as that sold under the trademark Formica which is made from urea-and phenol-formaldehyde resins cured to a smooth, hard, durable finish. Such laminated materials are structurally strong and the plastic veneer finish provides a smooth, hard, waterproof working surface which is extremely durable and easy to clean. However, such laminated boards heretofore have been available only in flat stock and, as a result, the appearance of the finished cabinets have lacked the mill-work relief surface which may be done easily on conventional wood panels. While decorative scrolling may be done to the surface of the plastic veneer, care must be taken to limit the penetration of the scrolling to something less than the thickness of the plastic typically one-sixteenth inch in order to maintain the integrity and finish of the plastic surface.

Figure 2:
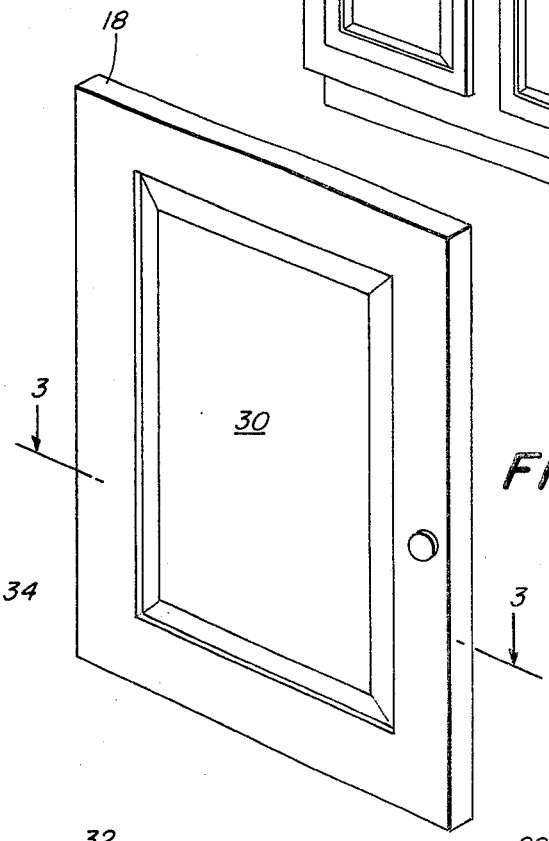
FIG. 2 is a view in perspective of a door made according to the invention.
Figure 3:
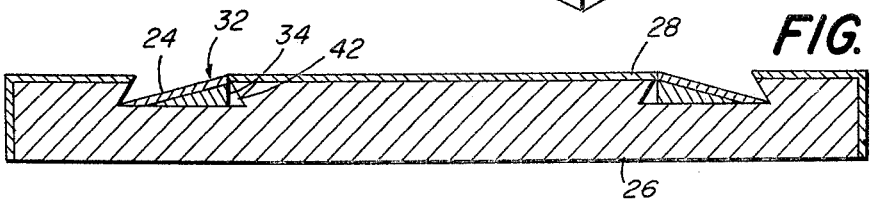
FIG. 3 is a cross-sectional view taken along the line 3—3 of FIG. 2.

In accordance with the present invention, as embodied in the door 18 of FIG. 2, a true relief configuration is imparted to the outer face of the door by first milling a rabbeted groove 24 into the outer face of the panel. As best shown in FIG. 3, the panel is comprised of a core 26 typically of chip-board, plywood or similar material perhaps one-half inch thick having good structural strength while the outer face and edges of the panel are covered with a veneer 28 of a hard plastic material such as that sold under the trademark Formica and which is fully bonded to the core 26. The groove 24, in the illustrated embodiment, is in a rectangular pattern inboard perhaps 2 inches from the edge of the door leaving a rectangular center section 30 defined by the groove. In the preferred embodiment, the groove is on the order of one-fourth inch in depth having a width of approximately 1 inch at its base and approximately seven-eighths inch at the groove opening. As best shown in FIG. 3, the sides of the grooves are angled in the manner shown for mounting an insert 32. Further-more, the rabbeted groove provides a shadow effect which substantially obscures from view the exposed portion of the core along the inclined walls of the groove in which the core 26 is not covered by the plastic veneer. More importantly, the undercut groove creates an illusion of a raised center panel 30. Also, the rabbeted groove serves to retain the insert strip 32 mounted in the groove.

Figure 4:
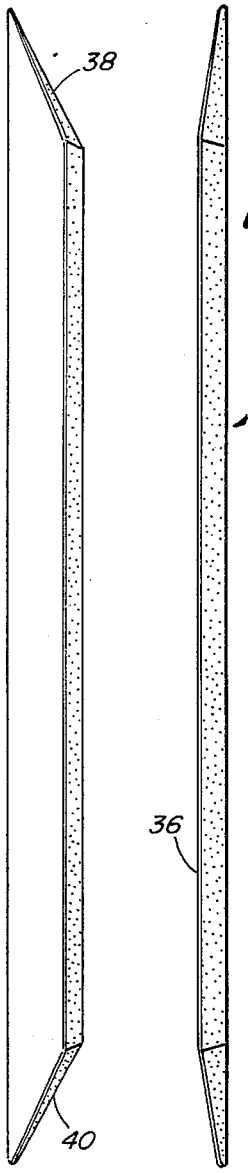
FIG. 4 is a view in perspective of an insert made according to the invention.
Figure 5:
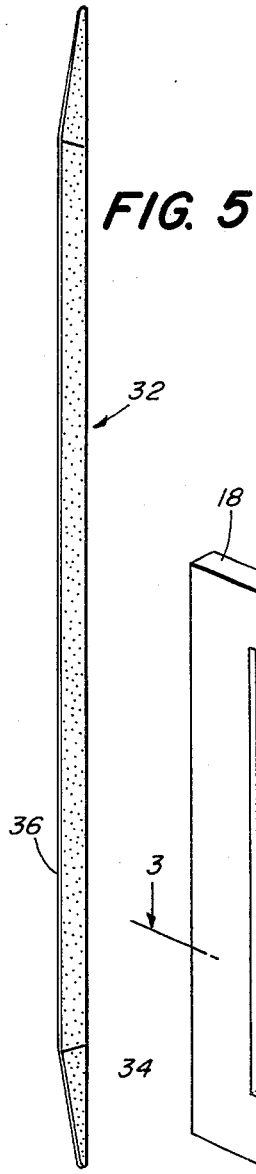
FIG. 5 is a view in side elevation of the FIG. 4 insert, and, FIG. 6 is a cross-sectional view similar to FIG. 3 but showing a modification of the invention.

The insert 32 as shown in FIGS. 3, 4 and 5, is comprised of an elongated strip for each section of the groove with each strip comprised of a core 34 on the outer face of which is laminated a veneer 36 of a hard plastic material similar to that on the laminated door 18. The core 34 may be of the same chip-board material as in the core 26 or other material such as wood or a relatively stiff plastic such as PVC or the like may be utilized. The hard plastic veneer 36 may be of the same color and design as that used on the door or it may be of a contrasting color, a different pattern or other variation as desired. In any event, the insert 32 is wedge-shaped or tapered in transverse cross-section as shown in FIG. 3 with the ends mitered at 45° angles to match similarly mitered ends of adjacent inserts to form neatly mitered corners as best shown in FIG. 2. The thin edge of the insert seats along the outer corner of the groove 44 while the thicker edge seats along the inner portion of the groove and, in practice, the thicker portion is one-fourth inch thick corresponding with the depth of the groove so that the inboard front edge of the insert will butt neatly against the flat surface of the center section 30 of the panel 18.

The base of the insert, which has a cross-section of a right triangle, as best shown in FIG. 3, is perpendicular to the flat bottom wall of the groove 24 to define a triangular void 42 which allows the insert to be manipulated in and out of the groove. In practice, the insert is dimensioned to fit neatly within the groove so that the insert may be held in place by friction fit and leaving exposed only the inclined outer side wall of the groove 24. Insofar as the wall is inclined outwardly towards the edge it will not be readily apparent to the casual viewer. However, in some instances it may be desirable to apply a coating of paint or stain over the inclined outer wall of the groove to match the panel surface or to match the insert surface, if they differ.

While the insert, if carefully fabricated, may snap into position and be held by friction, it may be desirable to cement the insert in place, particularly where a permanent connection is to be made, or if a removable insert mounting is desired, connectors such as pins may be added to the groove 24 or to the insert. Alternatively, a light pressure-sensitive adhesive may be employed which will release if the strip is pried out of the groove.

The appearance of the finished panel with the insert mounted in the groove is one of a relief surface much like a conventional millwork panelled all wood door with the advantage that exposed surfaces are substantially fully covered by the desirable hard plastic veneer.

Figure 6:
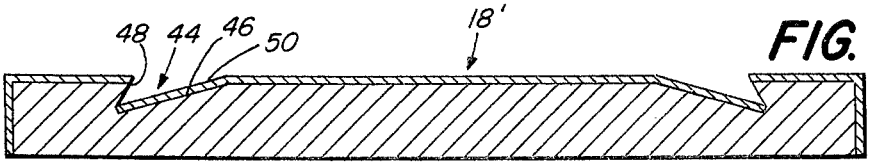

Referring now to FIG. 6 of the drawings, there is illustrated a modification of the invention and in this embodiment instead of a rabbeted groove, an angular groove 44 is formed in a panel 18' defining an inclined back wall 46 and an inclined side wall 48 with the back wall 46 originating at the surface of the panel so that a strip 50 of plastic veneer, such as Formica, when applied over the wall 46 will join neatly with the laminated outer face of the panel 18'. The strip 50 fully covers the inclined wall 46 terminating at the base of the wall 48 to produce the same relief appearance as in the principal embodiment.

The relief configuration may be applied to doors, facia pieces, drawer fronts, full wall panels or the like, wherever a relief appearance is desired. The resulting panel makes the veneered cabinet work more like that of conventional millwork wood cabinets but with the added advantage of the hard plastic veneer surface which is more durable, more easily cleaned and more resistant to water marking, stains, or the like, than conventional all wood panels.

Having thus described the invention what we claim and desire to obtain by Letters Patent of the United States is:

1. The method of producing a relief surface in the front face of a flat panel having a relatively thick one-piece core and a relatively thin, hard plastic veneer prebonded to the outer surface thereof, comprising the steps of a. cutting away an elongated undercut groove of substantially constant width and depth inwardly from the edges of said panel in a predetermined pattern completely through said veneer from said front face and partially into said core, and, b. applying an elongated hard plastic veneer strip of substantially constant width and thickness over at least one exposed core wall of said groove and in butting edge-to-edge contact with one edge of the veneer on the face of said panel bordering said groove.

2. The method of claim 1 wherein said groove is rabetted and said strip is triangular in transverse cross-section.

3. The method of claim 1 wherein said groove in angular and said strip is of the same thickness throughout.

4. A relief panel, comprising a. a relatively thick one-piece core, b. a relatively thin hard plastic veneer bonded to the outer surface of said core, c. said panel being formed inwardly from the edges thereof with an elongated undercut groove of substantially constant width and depth in a predetermined pattern completely through said veneer and partially into said core, d. an elongated hard plastic veneer strip of substantially constant width mounted over at least one exposed wall of said core groove, the outermost edge of said strip being in butting edge-to-edge contact with the edge of said veneer bordering said groove to form a substantially continuous veneer surface therewith.

5. A relief panel according to claim 4 wherein said groove is rabbeted and said strip is triangular in tranverse cross-section.

6. A relief panel according to claim 5 wherein the maximum thickness of said strip is substantially equal to the depth of said groove and the outermost corner of the strip is in mating contact with the edge of said veneer bordering said groove.

7. A relief panel according to claim 4 wherein said pattern is rectangular and a strip is mounted in each side thereof, the ends of said strips being mitered.

8. A relief panel according to claim 7 wherein each of said strips includes a core of transverse triangular cross-section and a hard plastic veneer on the outer face thereof.

9. A relief panel according to claim 4 wherein said groove is in the form of an acute angle in transverse cross-section and said strip is of a uniform thickness mounted to the exposed face of said groove.

* * * * *